US005376411A

United States Patent [19]

Nishishita

[11] Patent Number: 5,376,411

[45] Date of Patent: Dec. 27, 1994

[54] METHOD FOR ANTIMICROBIAL TREATMENT OF HEAT EXCHANGERS

[75] Inventor: Kunihiko Nishishita, Konan, Japan

[73] Assignee: Zexel Corporation, Tokyo, Japan

[21] Appl. No.: 120,391

[22] Filed: Sep. 14, 1993

[30] Foreign Application Priority Data

Oct. 1, 1992 [JP] Japan ..... 4-286617

[51] Int. Cl.[5] ..... B05D 3/02; B05D 1/18; B23P 15/26

[52] U.S. Cl. ..... 427/379; 427/255.6; 427/302; 427/314; 427/318; 427/327; 427/384; 427/386; 427/387; 427/388.1; 427/397.8; 427/402; 427/403; 427/409; 427/410; 427/421; 427/430.1; 427/435; 29/890.03; 106/15.05; 106/18.33; 165/133

[58] Field of Search ..... 106/18.33, 15.05; 427/435, 407.1, 384, 387, 379, 421, 255.6, 302, 314, 318, 327, 2, 388.1, 402, 403, 409, 410, 397.7, 397.8, 386; 29/890.03

[56] References Cited

U.S. PATENT DOCUMENTS

| | | | |
|---|---|---|---|
| 3,817,762 | 6/1974 | Brake | 106/18.32 |
| 3,845,212 | 10/1974 | Yovich et al. | 106/18.32 |
| 5,201,119 | 4/1993 | Mizuno et al. | 427/327 |

FOREIGN PATENT DOCUMENTS

| | | |
|---|---|---|
| 60-050397 | 3/1985 | Japan . |
| 63-061062 | 3/1988 | Japan . |
| 64-010072 | 1/1989 | Japan . |
| 1314158 | 12/1989 | Japan . |
| 2101395 | 4/1990 | Japan . |
| 3051698 | 3/1991 | Japan . |
| 3177796 | 8/1991 | Japan . |
| 3195894 | 8/1991 | Japan . |
| 3244997 | 10/1991 | Japan . |

*Primary Examiner*—Anthony Green
*Attorney, Agent, or Firm*—Wenderoth, Lind & Ponack

[57] ABSTRACT

A heat exchanger is immersed in a hydrophilic-film-forming solution in order to form a hydrophilic film on the surface of the heat exchanger. The film applied on the heat exchanger is then dried to a semi-dry state and while this film is semi-dry, an antimicrobial agent is permeated into the hydrophilic film. Then it is completely dried. By following this process, it is possible to permeate a large amount of antimicrobial agent near the surface of the film, increasing the antimicrobial effect and at the same time, the effect is retained over a long period of time because the antimicrobial agent is not coated on the surface and, therefore, is not washed away with water.

14 Claims, 1 Drawing Sheet

METHOD FOR ANTIMICROBIAL TREATMENT OF HEAT EXCHANGERS

BACKGROUND OF THE INVENTION

1. Field of the Invention

The present invention relates to an antimicrobial treatment method for heat exchangers and evaporators, especially those used in automotive air conditioners and the like.

2. Related Art

The heat exchanger disclosed in the Japanese Patent Unexamined Publication 1983/102,073, employs a method of preventing odors in the air blown out from the air conditioner that comprises the application of an organic polymer film containing a fungicide, an antiseptic, a deodorant and a surface active agent on the heat exchanger. As a means of hydrophilic treatment, anticorrosion treatment, mildew proofing and sterilization treatment, the heat exchanger is immersed in a solution in which a surface active agent, a mildew proofing agent, an antiseptic and a deodorant are dissolved, to apply the aforementioned organic polymer film on the heat exchanger, which is then air dried.

Also, in the heat exchanger that is disclosed in the Japanese Patent Unexamined Publication 1985/50,397, an organic polymer resin film containing a disinfectant of low solubility in water is formed on the corrugated fins and then a hydrophilic treatment is applied on top of it to prevent water from collecting on the corrugated fins and the attendant problems this gives rise to, including, for example, increased ventilation resistance, water splashing on the corrugated fins, corrosion of the corrugated fins, propagation of microorganisms and mildew and malodor caused by dust contamination. In this method, the heat exchanger is immersed in a mixed solution which comprises a disinfectant dissolved into a hydrophilic-treatment liquid to form the aforementioned organic polymer film, which is then dried in a hot air circulating dryer.

Furthermore, in the heat exchanger disclosed in Japanese Patent Unexamined Publication 1987/129,695, a film, comprising an anticorrosion film and a hydrophilic film, at least one of which contains an antiseptic, is formed. Also, in the heat exchanger disclosed in the Japanese Patent Unexamined Publication 1990/101,395, a hydrophilic film that includes a first fast-acting antimicrobial agent and a second slow-acting antimicrobial agent is provided. Furthermore, in the heat exchanger disclosed in the Japanese Patent Unexamined Publication 1989/10,072, a disinfectant that is coated with a film such as a synthetic resin with varying degrees of solubility is dispersed in the surface film. In the heat exchanger that is disclosed in the Japanese Patent Unexamined Publication 1989/314,158, a silicon-type film with an antimicrobial agent dispersed in it is provided on the corrugated fins. Furthermore, in the heat exchanger that is disclosed in the Japanese Patent Unexamined Publication 1991/177,796, a resin film containing a mildew-proofing agent is formed on top of a hydrophilic film. In the heat exchanger that is disclosed in the Japanese Patent Unexamined Publication 1991/244,997, a hydrophilic film mixed with a germicide and a mildew proofing agent is provided.

Also, in Japanese Patent Unexamined Publication 1991/51,698, a heat exchanger is disclosed wherein part of the film that is formed on the surface of the fins that contains an antimicrobial agent is a resin that possesses the property of becoming porous after being dissolved in water.

Furthermore, in the Japanese Patent Unexamined Publication 1991/195,894, a mildew-proofing compound is disclosed wherein a solution in which the mildew-proofing substance has been dissolved is mixed at a specific ratio with a resin film-forming solution to achieve a specific ratio (0.2–50, weight %) of the mildew-proofing substance to the resin film.

In manufacturing the aforementioned heat exchangers, if an antimicrobial agent is mixed in a liquid resin or in a hydrophilic-treatment liquid, a specific amount of antimicrobial agent is present in the hydrophilic film on the surface. This method has the advantage that the antimicrobial agent will have a long lasting effect. However, because there is a limit to the solubility of the antimicrobial agent, there is also a limit to the degree of antimicrobial action.

There is another method in which an antimicrobial agent is applied by means of spraying after the hydrophilic treatment and the drying treatment are completed. This method has the advantage of providing excellent immediate effect. On the other hand, because the antimicrobial agent is applied only superficially with this method, it presents the problem that the antimicrobial agent will be washed away by condensation water, resulting in a short-term antimicrobial effect.

SUMMARY OF THE INVENTION

The objective of the present invention is to provide a method of antimicrobial treatment for heat exchangers in which superior and a long lasting antimicrobial effect can be obtained.

In order to achieve this objective, the method of antimicrobial treatment for heat exchangers of the present invention consists of the following: immersing a heat exchanger in a hydrophilic-film-forming solution in order to form a hydrophilic film on the surface of the heat exchanger, partially drying the hydrophilic film that has been applied on the heat exchanger and, with this hydrophilic film in a semi-dried state, permeating an antimicrobial agent into the hydrophilic film and then finally drying it completely.

Therefore, in the present invention, since the heat exchanger is immersed in a hydrophilic-film-forming solution in order to form a hydrophilic film on the surface, and since, with this hydrophilic film in a semi-dried state, an antimicrobial agent is permeated into the hydrophilic film, a high degree of antimicrobial effect can be achieved because a great quantity of the antimicrobial agent is present near the surface of the hydrophilic film and also the antimicrobial action can be maintained for a long time because the antimicrobial agent is not only applied to the surface of the film but is permeated into the film.

BRIEF DESCRIPTION OF THE DRAWINGS

A more complete appreciation of the invention and many of the attendant advantages thereof will be readily obtained as the same becomes better understood by reference to the following description when considered in connection with the accompanying drawings wherein.

DETAILED DESCRIPTION OF THE PREFERRED EMBODIMENT

Figure 1:
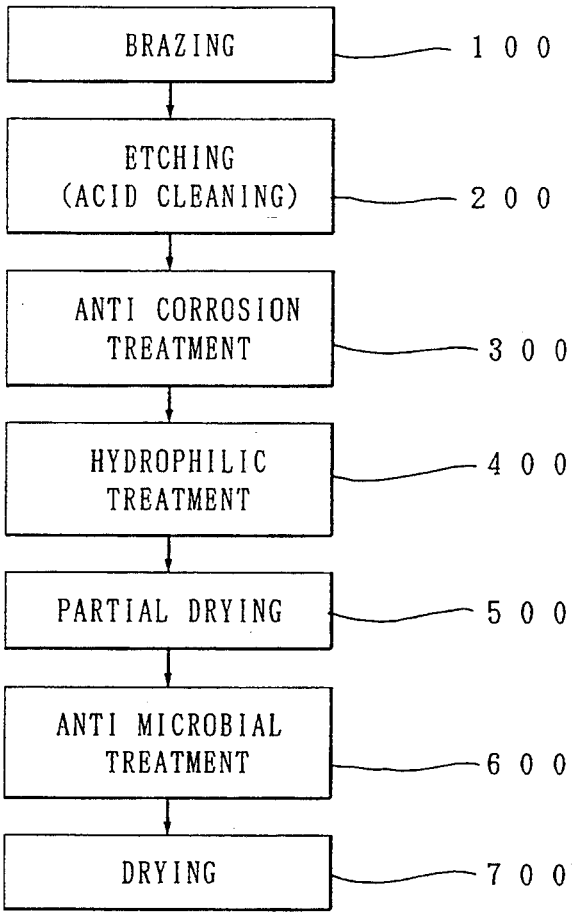
FIG. 1 is a block diagram illustrating the antimicrobial treatment method in the preferred embodiment of the present invention.

FIG. 1 is a block diagram illustrating the treatments, from brazing through drying, that are performed on the heat exchanger. The following explanation uses this diagram.

First, in block 100, the temporarily assembled heat exchanger is brazed in the furnace to ready it for the following steps, that is, pre-treatments for anticorrosion performed in blocks 200 and 300.

In block 200, the heat exchanger is etched (acid cleaned) to wash away the cladding material and the like. In block 300, an anticorrosion treatment, such as chromic acid chromate filming or phosphoric acid chromate filming is performed.

In block 400, a hydrophilic treatment in which the heat exchanger is immersed in a hydrophilic-film-forming solution that has been prepared by dissolving hydrophilic-film-forming materials such as a combination of polymeric silica and an alkali silicate (inorganic type), or a combination of an acryl-epoxy resin and polymeric silica (organic type+inorganic type) in order to form a hydrophilic film. After this, excess hydrophilic-film-forming materials adhering to the heat exchanger are removed with a centrifugal separator. Then, in block 500, the hydrophilic film-forming material adhering on the surface of the heat exchanger as desired is partially dried in a drier or simply air dried for a short time to form a hydrophilic film of a specific thickness (for example, 0.5–1 micrometers) in a semi-dry state.

After that, in block 600, treatment with an antimicrobial agent is performed on the heat exchanger on which the semi-dry hydrophilic film has been formed.

This antimicrobial treatment is performed in order to permeate an antimicrobial agent into the semi-dry hydrophilic film and there are several methods available, including an antimicrobial spray that is atomized over the entirety of the heat exchanger in an atomizing chamber, and another method wherein a sealed chamber is filled with a mist of antimicrobial agent and the heat exchanger is left in it for a specific period of time. It should be noted that the reasons for permeating the antimicrobial agent while the hydrophilic film is in semi-dry state are that if it were permeated immediately after the hydrophilic film is applied and is still wet, there is the possibility that the hydrophilic film, not having set properly, would start to run, resulting in uneven distribution of the antimicrobial agent. This would cause inconsistent antimicrobial effect, depending upon location. Also, if the antimicrobial agent is permeated after the hydrophilic film is totally dry, the agent will only adhere to the surface and there will be the problem of the antimicrobial agent being easily washed away by water. Only when the antimicrobial agent is applied to the semi-dry film, is the desired effect achieved.

As an antimicrobial agent, normally a combination of 2-(4'-Thiazolyl)-benzimidazole ($C_{16}H_7N_3S$: T B Z (Thiabendazole)) and 2,3,5,6-Tetrachloro 4 (methyl sulphnyl) pyridine ($C_6N(Cl)_4SO_2CH_3$:Dencil S-25), or a combination of the aforementioned TBZ and para-chloro-meta-xylenole ($C_8H_9OCl$:PCMX) should be used.

Figure 2:
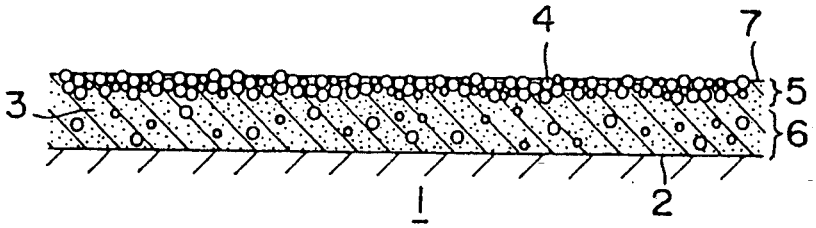
FIG. 2 is a cross-section view of the preferred embodiment of the present invention illustrating the hydrophilic film into which an antimicrobial agent is permeated.

With this, as shown in FIG. 2, the antimicrobial agent 4 is permeated into the hydrophilic film 3 in a semi-dry state which has been applied on the surface 2 of the heat exchanger 1 to form a hydrophilic film 3 that has an antimicrobial effect. Then, in block 700 drying is performed to completely dry the hydrophilic film 3.

Because of this, the aforementioned antimicrobial agent 4 is permeated into the hydrophilic film 3 in such a way that it is distributed heavily near the surface 5 of the hydrophilic film 3 and distributed thinly in the inner part 6. Therefore, the antimicrobial agent 4 is present in concentration near the surface 5 where the antimicrobial effect is most needed.

Furthermore, as this antimicrobial agent 4 is permeated into the surface area 5, it is not merely adhering to the surface 7, and it is not easily washed away by water that has condensed on the surface of the heat exchanger.

As has been described above, with the present invention, as the hydrophilic film is permeated with an antimicrobial agent while in a semi-dry state so that the antimicrobial agent is distributed heavily near the surface where the antimicrobial effect is most needed. Thus, an superior antimicrobial effect is achieved and as the antimicrobial agent is not adhering to the surface but is permeated into the surface, the effect is long lasting.

Also, with the present invention, malodor from the air conditioner is reduced due to the mildew-proofing and antimicrobial effects in the heat exchanger.

The present invention is described by referring to the drawings which are examples of implementation. However, the present invention should not be interpreted as being confined to these examples only. It is self evident to this artisan that many variations can be achieved within the scope of the present invention whereby the objectives of the present invention and other objectives and the accompanying benefits will be easily attained.

What is claimed is:

1. A method for applying an antimicrobial agent to a heat exchanger which comprises:

(a) immersing the heat exchanger in a hydrophilic-film-forming solution to form a hydrophilic film on a surface of the heat exchanger, (b) partially drying the hydrophilic film, (c) applying an antimicrobial agent on the hydrophilic film while the film is in a semi-dry state so that the antimicrobial agent permeates the hydrophilic film, wherein the antimicrobial agent is applied in an effective amount to retard growth of microorganisms on the surface of the heat exchanger, and (d) completely drying the hydrophilic film.

2. The method according to claim 1, wherein the antimicrobial agent is applied to the hydrophilic film by contacting the hydrophilic film with an atomized spray of the antimicrobial agent in an atomizing chamber.

3. The method according to claim 1, wherein the antimicrobial agent is applied to the hydrophilic film by contacting the hydrophilic film with a mist of the antimicrobial agent in a sealed chamber.

4. The method according to claim 1, wherein the hydrophilic-film-forming solution comprises a mixture of polymeric silica and alkali silicate.

5. The method according to claim 1, wherein the hydrophilic-film-forming solution comprises a mixture of polymeric silica and acryl-epoxy resin.

6. The method according to claim 1, wherein the antimicrobial agent is a mixture of 2-(4'-Thiazolyl)-benzimidazole ($C_{16}H_7N_3S$) and 2, 3, 5, 6-Tetrachloro 4-(methyl sulphnyl) pyridine ($C_6N(Cl)_4SO_2CH_3$).

7. The method according to claim 1, wherein the antimicrobial agent is a mixture of 2-(4'-Thiazolyl)-benzimidazole ($C_{16}H_7N_3S$) and para-chloro-meta-xylenole ($C_8H_9OCl$).

8. A heat exchanger having a surface coating of an antimicrobial agent, said surface coating being formed on the heat exchanger by:

(a) immersing the heat exchanger in a hydrophilic-film-forming solution to form a hydrophilic film on a surface of the heat exchanger, (b) partially drying the hydrophilic film, (c) applying an antimicrobial agent on the hydrophilic film while the film is in a semi-dry state so that the antimicrobial agent permeates the hydrophilic film, wherein the antimicrobial agent is applied In an effective amount to retard growth of microorganisms on the surface or the heat exchanger, and (d) completely drying the hydrophilic film, wherein the hydrophilic-film-forming solution is selected from the group consisting of (i) a mixture or polymeric silica and alkali silicate and (ii) a mixture of polymeric silica and acrylepoxy resin, and wherein the antimicrobial agent is selected from the group consisting of (i) a mixture of 2-(4'-Thiasolyl)-benzimidazole ($C_{16}H_7N_3S$) and 2,3,5,6-Tetrachloro 4--(methyl sulphnyl) pyridine ($C_6N(Cl)_4SO_2CH_3$) and (ii) a mixture or 2-(4'-Thiazolyl)-benzimidazole ($C_{16}H_7N_3S$) and para-chloro-meta-xylenole ($C_8H_9OCl$).

9. The heat exchanger according to claim 8, wherein the antimicrobial agent is applied to the hydrophilic film by contacting the hydrophilic film with an atomized spray of the antimicrobial agent in an atomizing chamber.

10. The heat exchanger according to claim 8, wherein the antimicrobial agent is applied to the hydrophilic film by contacting the hydrophilic film with a mist of the antimicrobial agent in a sealed chamber.

11. The heat exchanger according to claim 8, wherein the hydrophilic-film-forming solution comprises a mixture of polymeric silica and alkali silicate.

12. The heat exchanger according to claim 8, wherein the hydrophilic-film-forming solution comprises a mixture of polymeric silica and acryl-epoxy resin.

13. The heat exchanger according to claim 8, wherein the antimicrobial agent is a mixture of 2-(4'-Thiazolyl)-benzimidazole ($C_{16}H_7N_3S$) and 2, 3, 5, 6-Tetrachloro 4-(methyl sulphnyl) pyridine ($C_6N(Cl)_4SO_2CH_3$).

14. The heat exchanger according to claim 8, wherein the antimicrobial agent is a mixture of 2-(4'-Thiazolyl)-benzimidazole ($C_{16}H_7N_3S$) and para-chloro-meta-xylenole ($C_8H_9OCl$).

* * * * *